US006644378B2

(12) United States Patent
Mitchell

(10) Patent No.: US 6,644,378 B2
(45) Date of Patent: Nov. 11, 2003

(54) TENSIONING DEVICE FOR A DOOR SYSTEM

(75) Inventor: Albert W. Mitchell, Pensacola, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 10/001,470

(22) Filed: Nov. 2, 2001

(65) Prior Publication Data

US 2003/0094248 A1 May 22, 2003

(51) Int. Cl.[7] ..... E05F 11/00
(52) U.S. Cl. ..... 160/191; 160/315
(58) Field of Search ..... 160/191, 192, 160/193, 189, 201, 315; 16/197, 198, DIG. 1, DIG. 7

(56) References Cited

U.S. PATENT DOCUMENTS

| | | | | |
|---|---|---|---|---|
| 1,827,433 A | | 10/1931 | Kendall | |
| 2,059,833 A | | 11/1936 | Winn, Jr. | 20/20 |
| 2,099,191 A | | 11/1937 | Blodgett | 20/20 |
| 3,635,277 A | | 1/1972 | Bahnsen | 160/191 |
| 3,842,892 A | | 10/1974 | Stieler | 160/133 |
| 3,921,761 A | | 11/1975 | Votroubek et al. | 185/39 |
| 4,253,350 A | | 3/1981 | De Tarr | 81/3 |
| 4,420,127 A | | 12/1983 | Kondziola et al. | 242/107.4 |
| 4,731,905 A | | 3/1988 | Milano et al. | 16/306 |
| 4,852,378 A | | 8/1989 | Greco | 72/379 |
| 4,882,806 A | | 11/1989 | Davis | 16/198 |
| 5,577,544 A | | 11/1996 | Carper et al. | 160/191 |
| 5,605,079 A | | 2/1997 | Way | 81/61 |
| 5,632,063 A | | 5/1997 | Carper et al. | 16/198 |
| 5,778,490 A | * | 7/1998 | Curtis | 160/191 X |
| 5,964,268 A | | 10/1999 | Carper et al. | 160/191 |
| 6,155,327 A | * | 12/2000 | Wells et al. | 160/191 X |
| 6,283,193 B1 | * | 9/2001 | Finch et al. | 160/191 |
| 6,527,037 B2 | | 3/2003 | Daus et al. | 160/315 |

FOREIGN PATENT DOCUMENTS

| | | | |
|---|---|---|---|
| EP | 0 397 618 | 11/1990 | E06B/9/56 |
| EP | 0 495 499 | 7/1992 | E06B/9/56 |

* cited by examiner

*Primary Examiner*—David Purol
(74) *Attorney, Agent, or Firm*—Renner, Kenner, Greive, Bobak, Taylor & Weber

(57) ABSTRACT

A tensioning assembly for a door system, which includes an upwardly acting door supported by a frame and connected to a counterbalance system having a counterbalance spring, the tensioning assembly including a rotatable tension plate coupled to the counterbalance spring and rotatable relative to the counterbalance spring, the tension plate being selectively moveable between a disengaged position where the tension plate is freely rotatable and an engaged position where the tension plate is rotationally fixed to the frame; and a spring adapted to urge the tension plate toward the engaged position, whereby when in the disengaged position the tension plate is rotatable to adjust tension in the counterbalance spring and the tension plate is returned to the engaged position to maintain the tension.

29 Claims, 11 Drawing Sheets

TENSIONING DEVICE FOR A DOOR SYSTEM

TECHNICAL FIELD

In general, the present invention relates to a tensioning device used to adjust the counterbalance tension in a door system. More particularly, the present invention relates to a tensioning assembly that adjusts tension on a torsional counterbalance spring employed to offset the weight of a sectional door movable between an open position and a closed position.

BACKGROUND ART

A familiar door system is a sectional door system, which includes a plurality of panels that pivot sequentially as the door travels between a generally vertical closed position and a generally horizontal open position. It will be appreciated that, due to the weight of these doors, an ordinary user may not be able to lift the door without assistance. Thus, to provide a counterbalancing force for the weight of the door, a counterbalancing system is attached to the door, as by a cable. Typically, the counterbalancing system includes a drive shaft or tube having one or more cable drums about which the cable is coiled or uncoiled depending on the direction of door travel. A counterbalance spring associated with the drive tube rotationally biases the drive tube to provide the counterbalancing force to the door. During installation or assembly of the door system, the spring is appropriately tensioned to provide the necessary counterbalancing force. Optimally, the counterbalance spring would have sufficient tension such that the door would fully close while only a small amount of force would be necessary to raise the door from the closed position. If the proper tension is not initially attained or the tension falls out of the proper range over time, the installer or user may make appropriate adjustment by way of a tensioning assembly.

In many instances, the door tensioning assembly includes a winding cone attached to the counterbalance spring at one end and displaying one or more receiving sockets for the insertion of a winding bar. To tension the counterbalance spring, a bar is inserted into the winding cone to give the installer the necessary leverage to torque the spring as necessary to apply or release tension within the spring. It will be appreciated, however, that the use of such a tensioning assembly carries inherent danger to the installer. To remove some of these safety concerns, wormgear drives are used in some cases to adjust the tension on the counterbalance spring. The wormgear allows the installer to adjust tension by a hand drill or a ratcheting wrench. In one design available in the industry, a door system having a torsion bar and spring assembly is used to transmit a counterbalancing force to a door with a wormgear tensioning assembly employed to adjust and maintain tension on the spring. The spring is fastened by hooks at both ends to prevent axial and longitudinal movement thereof. The wormgear rotates on a casting that forms the mount for the worm and is fastened to the torsion bar. In this design, separate fasteners are required at each point of torque transmission including the worm housing, the worm gear, the drums, cables, and cable pins. Also, the wormgear must have a relatively large diameter to handle the short torque movement of the large springs and drums. The size of the worm gear tensioning assembly of this design makes it unsuitable for lower headroom structures.

In another worm tensioning assembly, available in the industry, a wormgear device is provided for use with conventional garage door springs. This design requires the counterbalance spring be mounted over the drive tube. The wormgear is detachable, and all of the tensioning components are secured with fasteners. A counter shaft is used to reverse the rotation of the worm allowing fine adjustment of the spring tension. As in the previously described design, the spring must be secured from axial and longitudinal movement. An allowance, however, is provided for alteration of the length of the spring, as a result of winding.

Still other tensioning assemblies employ a ratcheting system to adjust tension on the counterbalance spring. Tension is applied in much the same manner as the winding cone tension assembly, but, to reduce the risk of injury to the installer, tension is maintained by the pawl's interaction with the gear teeth. One design, available in the industry, employs a collar, which can be slipped over the shaft around which the counterbalance spring is wound. The collar is fitted with a pair of ratcheting mechanisms and a device to hold these mechanisms in place. The collar is fastened to one end of the spring and turned to adjust the tension thereon. As the collar is rotated, the ratcheting mechanisms engage a boss on the collar to maintain the tension being applied to the spring.

Another design in the industry combines worm and ratchet systems in its tensioning assembly. This design includes a cone having a ring-shaped worm gear integrally formed thereon and attached to a counterbalance spring by way of a threaded connection. A worm drive is provided to rotate the ring-shaped spur gear. Rotation of the gear effects rotation of the cone, thereby adjusting tension on the counterbalance spring. A spring-loaded clip interacts with the gears to maintain the proper tension on the counterbalance spring.

In still another design, a ratcheting mechanism having a split housing is used to tension a counterbalance spring. Grooves are provided on either side of the split housing for receiving left and right hand ratcheting tools, which are simultaneously engaged and then used in sequence to create tension within the counterbalance spring. As in other designs, the ratcheting assembly prevents errant release of the spring's tension.

While worm and ratchet tensioning devices of the type discussed above and other variations remove some of the danger associated with the winding cone tensioning assembly, they are more complex and require more parts making them more costly to produce. Additionally, due to their complexity and the need to create sufficient mechanical advantage to tension the spring, these systems are often large relative to the drive tube, track and other door assemblies requiring additional space for their installation and making them unsuitable for a number of applications.

DISCLOSURE OF THE INVENTION

It is, therefore, an object of the present invention to provide a less complex tensioning assembly for an upwardly acting sectional door system having fewer parts and therefore reducing cost. Another object of the present invention is to provide a tensioning assembly that includes a tension plate, which selectively interacts with a counterbalance assembly to apply tension to the counterbalance spring, and has locking members adapted to maintain the tension on the counterbalance spring. Yet another object of the invention is to provide such a tensioning assembly that may be selectively engaged with the counterbalance assembly incrementally to adjust the tension thereon by rotating the tensioning assembly.

It is another object of the present invention to provide a more compact tensioning assembly for a sectional door. Yet another object of the present invention is to provide a tensioning assembly that is received within conventional track members associated with a sectional door and requires minimal side clearance for adjustment. Still another object of the present invention is to provide a tensioning assembly that has a radial dimension similar to that of conventional cable drums in a sectional door system. A further object of the present invention is to provide a tensioning assembly having a smaller radial dimension than the cable drums in a sectional door system. A still further object of the present invention is to provide such a tensioning assembly which can be employed with either torsional springs or extension springs and which does not have gears having a tendency to fail and require replacement when a spring fails.

In view of at least one of the foregoing objects, the present invention generally provides a tension assembly for a door system, which includes an upwardly acting door supported by a frame and connected to a counterbalance system having a counterbalance spring, the tensioning assembly including a tension plate coupled to the counterbalance spring and rotatable relative to the counterbalance spring, the tension plate being selectively moveable between a disengaged position where the tension plate is freely rotatable and an engaged position where the tension plate is rotationally fixed to the frame; a spring adapted to urge the tension plate toward the engaged position, whereby when in the disengaged position the tension plate is rotated relative to the counterbalance spring to adjust a tension therein and the tension plate is returned to the engaged position to maintain the tension.

The present invention further provides a tensioning assembly including an upwardly acting door supported by a frame and connected to a counterbalance system having a counterbalance spring, the tensioning assembly including a locking member attached to the counterbalance spring moveable to an engaged position to maintain a selected tension on the counterbalance spring, and a release assembly operative to selectively disengage the locking member allowing adjustment of tension within the spring.

BEST MODE FOR CARRYING OUT THE INVENTION

Figure 1:
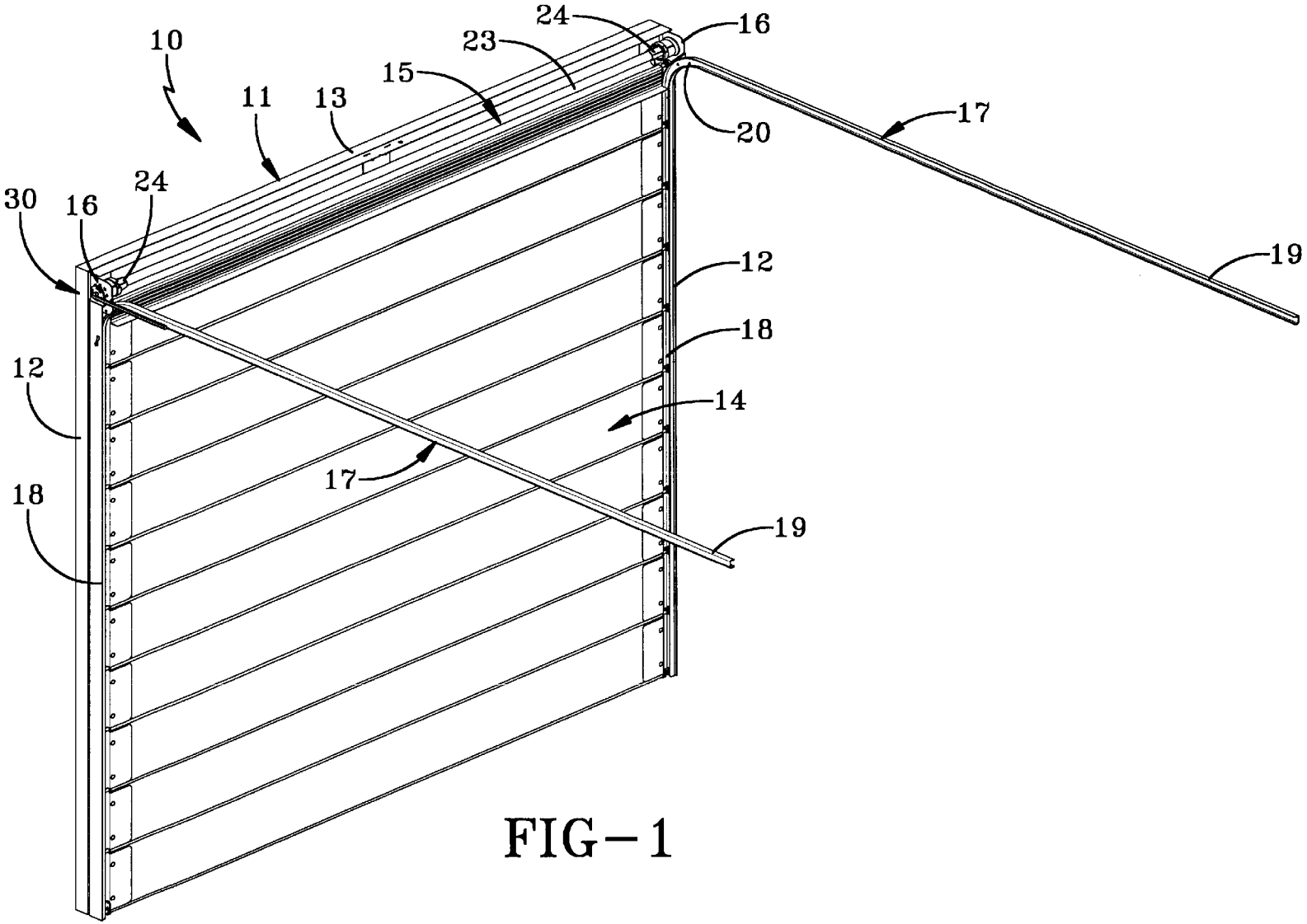
FIG. 1 is a rear perspective view of a sectional door system including a door located within an opening defined by a plurality of framers, a counterbalance system operative to provide a balancing force for the weight of the door, and a tensioning assembly according to the concepts of the present invention operatively attached to the counterbalance system to adjust and retain the force applied to the door by the counterbalance system.

A tensioning assembly according to the concepts of the present invention is shown in the accompanying figures, and generally indicated by the numeral 30. The tensioning assembly 30 is used in connection with a door system, generally indicated to by the numeral 10 in FIG. 1 of the drawings. The door system 10 is positioned and mounted for opening and closing movement in a building, trailer or other structure by a peripheral door frame, generally indicated by the numeral 11. The frame 11 consists of a pair of spaced vertical track framers 12, that, as seen in FIG. 1, are generally parallel and extend vertically upwardly relative to a supporting surface such as a floor or the bed of a trailer (not shown). The vertical track framers 12, 12 are spaced and joined proximate their vertical upper extremities by a header 13 to thereby define the generally inverted U-shaped frame 11 for mounting a door, generally indicated by the numeral 14. The frame 11 may be constructed of metal or other relatively high-strength, rigid material for purposes of reinforcement, attachment to a building or vehicle, and facilitating the attachment of elements involved in supporting and controlling the door 14. The header 13 may advantageously mount a counterbalance system, generally indicated by the numeral 15 that interacts with the door 14 to facilitate raising and lowering of the door 14 in a manner well known to persons skilled in the art. The counterbalance system 15 may be in accordance with the characteristics of a counterbalance system according to Applicant's Assignee's U.S. Pat. No. 5,419,010, which is shown for exemplary purposes and the disclosure therein incorporated herein by reference, with it being appreciated that any of a variety of different types of torsional or extension spring counterbalancing systems may be employed.

Figure 2:
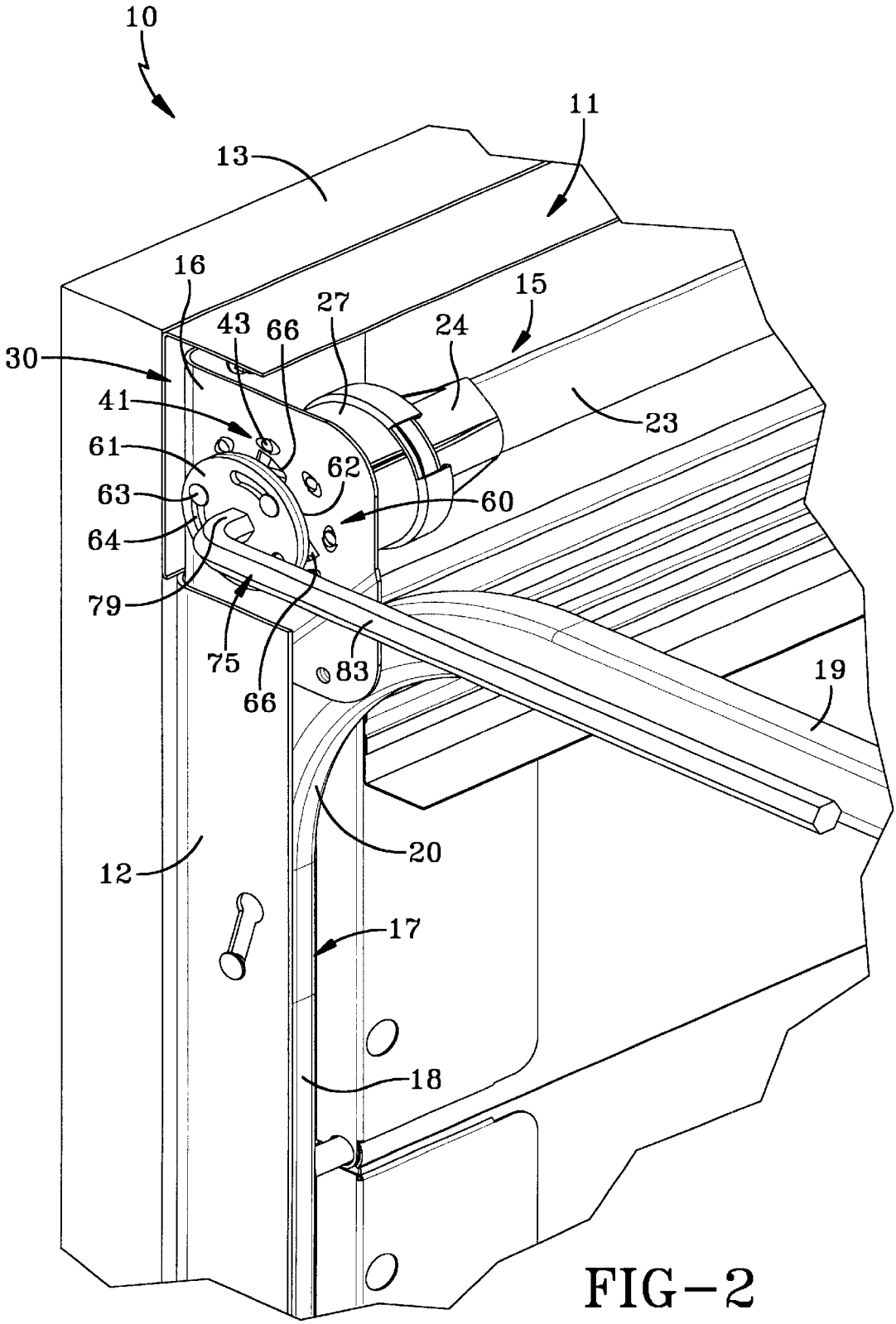
FIG. 2 is an enlarged fragmentary perspective view depicting the support bracket and tensioning assembly to the left of the door seen in FIG. 1 depicting details of the tensioning assembly, including a release assembly that includes a tool having a handle portion coupled to a first plate having fingers that extend through slots formed in the bracket to selectively release the tension plate.

As seen in FIGS. 1 and 2, brackets 16 are provided to partially support roller tracks, generally indicated by the numerals 17, 17, which are positioned to either side of the door 14. Each of the roller tracks 17, 17 include substantially vertical track sections 18, 18 formed in the vertical track framers 12, 12, substantially horizontal track sections 19, 19 and transition track sections 20, 20 interposed therebetween. As shown, the transition sections 20, 20 may be integral with horizontal track sections 19, 19 such that the sections 19 and 20 may be decoupled from vertical section 18 for storage and transport.

The roller tracks 17, 17 in a known manner thus support and direct travel of the door 14 in moving from the closed vertical position depicted in FIG. 1 associated with vertical track sections 18, 18 of roller tracks 17, 17 through transition track sections 20, 20 to the open, horizontal position associated with horizontal track sections 19, 19. The ends of horizontal track sections 19, 19 displaced from the door 14 are joined and supported by a back bar (not shown) attached directly or indirectly to the ceiling or walls of a structure in which the door system 10 is installed.

Door system 10 includes a counter balance system 15, which may include a counterbalance spring 22 (FIG. 3) operatively attached at one end to a drive tube 23 and at an opposite end to tensioning assembly 30 such that an appropriate counterbalancing force may be developed in counterbalance spring 22. Counterbalance tube 23 supports a pair of cable drums 24, at either end to which a cable 25 that operatively interrelates the counterbalance system 15 to the door 14 is attached. A counterbalance system according to the concepts of Applicant's U.S. Pat. No. 5,419,010, is shown for exemplary purposes and incorporated herein by reference. While, in accordance with the concepts of U.S. Pat. No. 5,419,010, the counterbalance spring 22 is located within drive tube 23, a counterbalance spring 22 located externally of a drive tube or solid drive shaft 23 can be employed with the tensioning assembly 30 in accordance with the concepts of the present invention. Cable 25 has one end attached to cable drum 24 and is received about the cable drum 24 with the other end of the cable 25 attached to the door 11 preferably proximate the bottom door section in a manner well known in the art. Cable drum 24 is rotationally coupled to drive tube 23 in accordance with Applicant's U.S. Pat. No. 5,419,010, by a drive tube 23 which is non-circular in cross-section, but, as will be appreciated, may be attached according other more commonly used methods, for example, a pin, set screw or key, such that cable drum 24 rotates with drive tube 23 to effect selective coiling and uncoiling of the cable 25 as the door 14 is raised and lowered. To protect and control the cable 25, cable drums 24 may be covered by a shroud 27. Tension in counterbalance system 15 sufficient to balance the weight of the door 14 is generated by relative rotation of the ends of the counterbalance spring 22. As mentioned, one end of the counterbalance spring 22 is attached to the drive tube 23 for this purpose. The opposite end of counterbalance spring 22 attaches to tensioning assembly 30 that operates to develop the necessary tension within counterbalance spring 22 to counteract the weight of door 14, as will be described below.

Figure 2A:
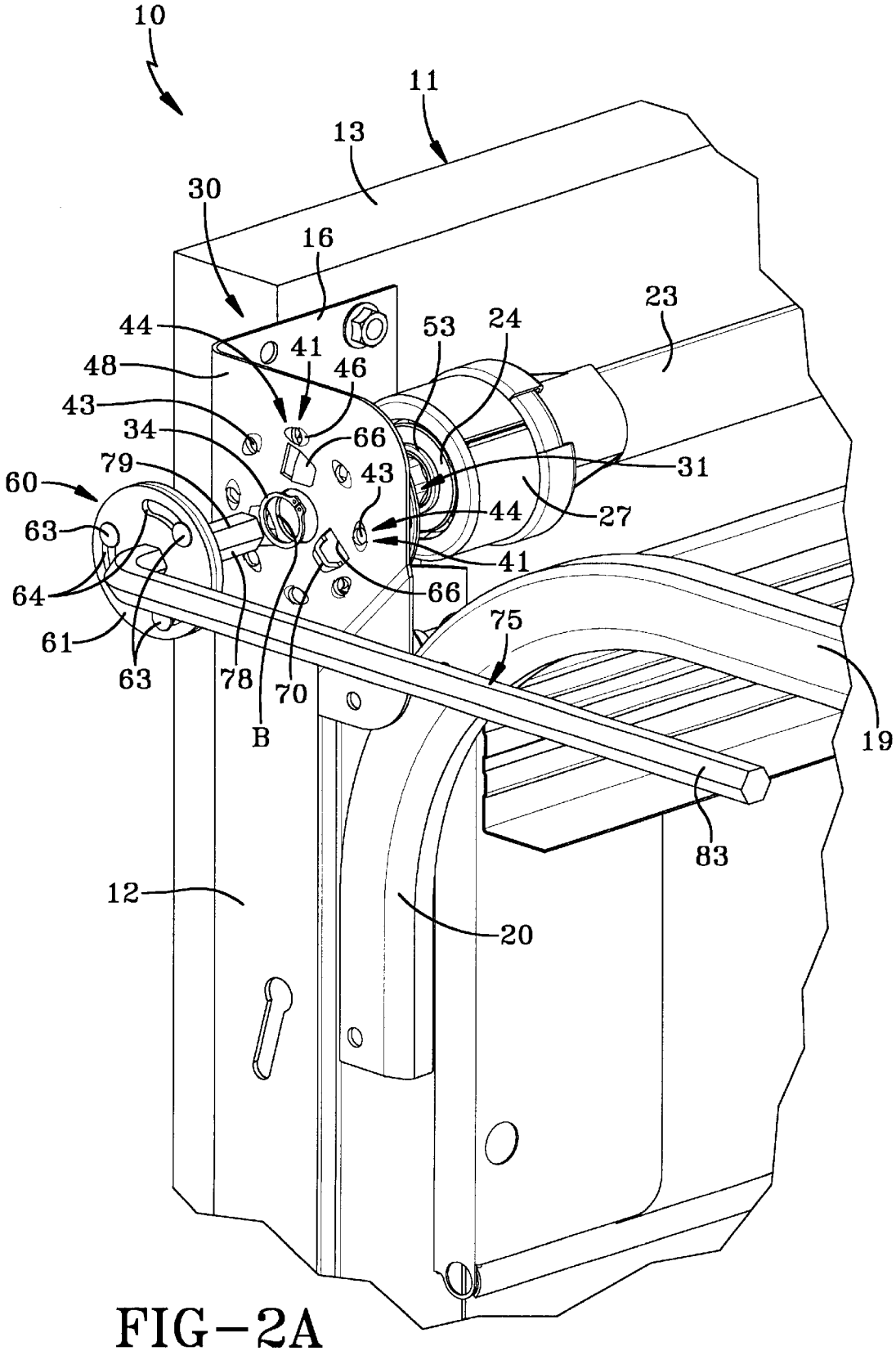
FIG. 2A is an enlarged exploded perspective view depicting additional details of the tensioning assembly depicted in FIG. 1 including a working end of the tool shown extending axially beyond the first plate and further depicting details of the slots formed to receive the fingers and a plurality of locking member receivers circumferentially spaced at equal angles about a circle located radially outward of the slots.
Figure 3:
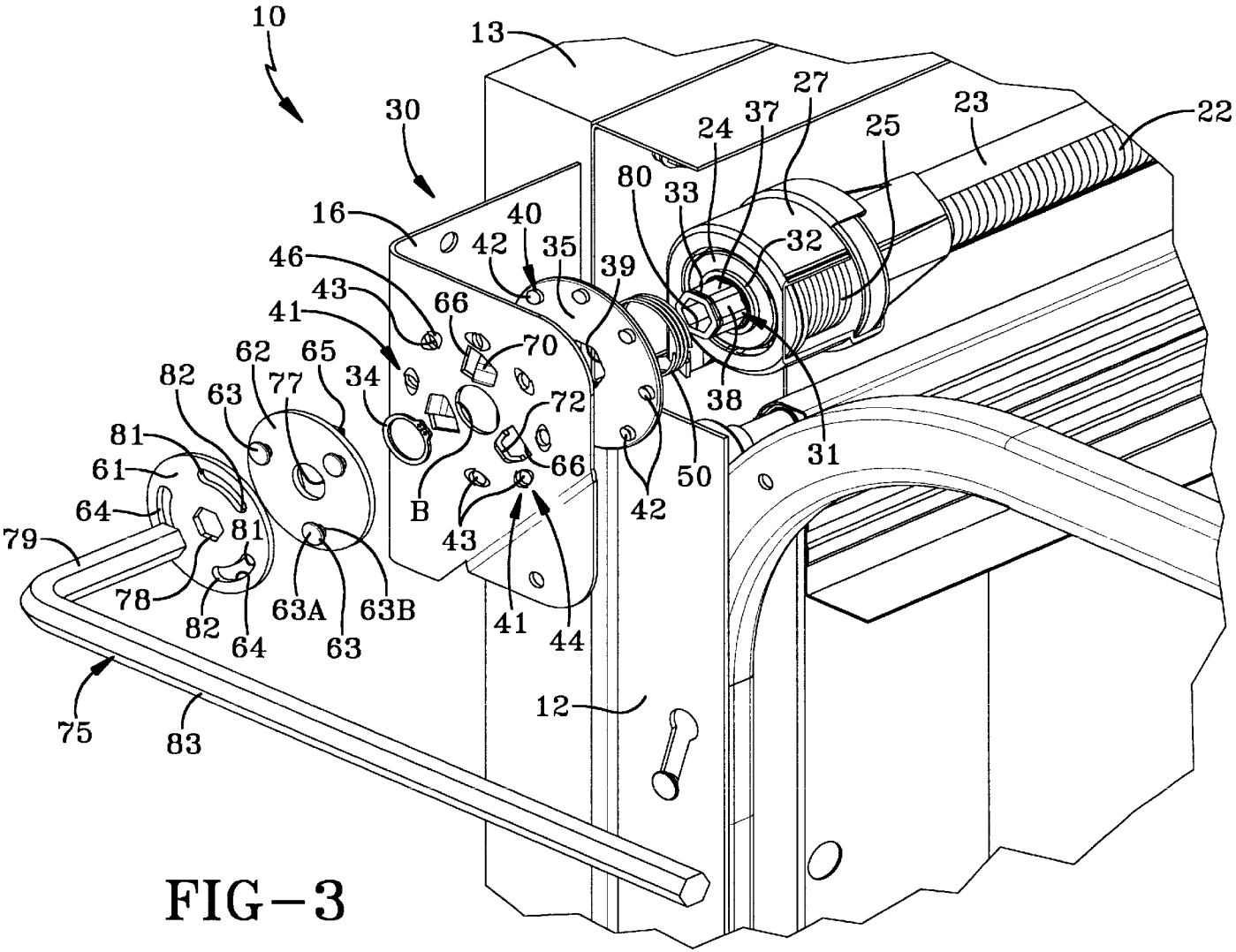
FIG. 3 is an enlarged exploded perspective view similar to FIG. 2A depicting additional details of the tensioning assembly including details of a tension plate having a plurality of locking members adapted to be received within the locking member receivers, when the tension plate is in an engaged position, a spring located between a cable drum and the tension plate to bias the tension plate toward engagement with the locking member receivers, and a winding shaft housed within the bore of the cable drum having a head portion that extends axially outward of the cable drum defining a socket formed therein for receipt of the working end of the tool having an interior surface that mates with the working end such that the tool may rotate the winding shaft to adjust tension on the counterbalance spring.
Figure 4:
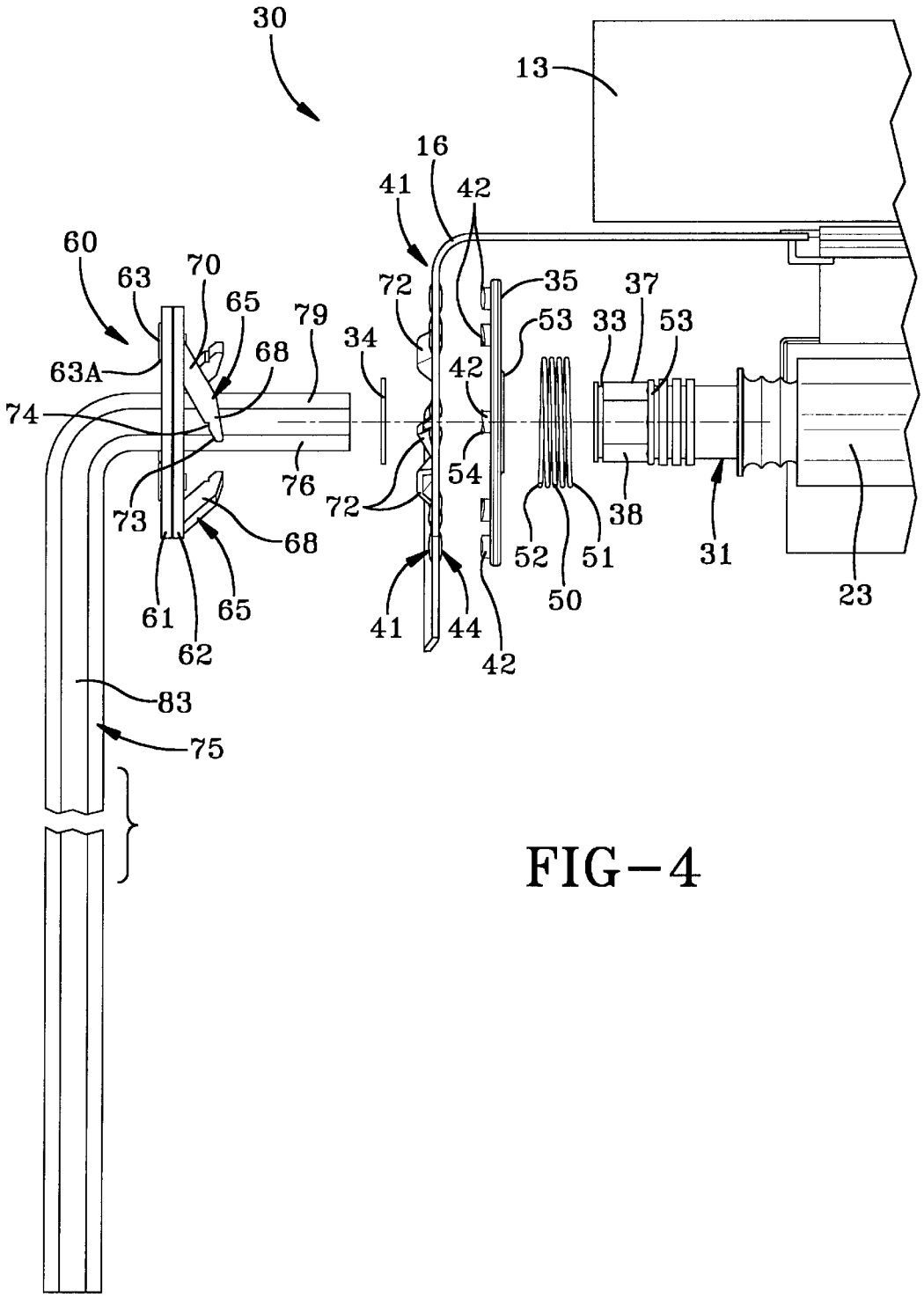
FIG. 4 is an exploded top plan view of the tensioning assembly as seen in FIG. 2 with the cable drum removed to depict further details of the tensioning assembly including details of the winding shaft and head portion, and also depicting the locking members having ends sloped outward in a direction opposite the force of the torsional counterbalance spring.

Referring particularly to FIGS. 2A, 3 and 4, tensioning assembly 30 includes a winding shaft, generally indicated by the numeral 31 (FIG. 4), located within a bore 32 of cable drum 24 and in registry with drive tube 23. Winding shaft 31 is supported at its outward end 33 by bracket 16 and is axially fixed relative thereto by a clip, pin or similar device. In the embodiment shown, a portion of winding shaft 31 extends through and is received in a central bore B formed in bracket 16, which is made circular to allow free relative rotation of the winding shaft 31. A retaining ring 34 is attached to the portion of winding shaft 31 extending through bore B and fit within an annular notch 33 formed proximate the end of winding shaft 31. A portion of the winding shaft is housed within cable drum 24 and may be journaled therein, as by suitable bearings, such that winding shaft 31 is freely rotatable relative to cable drum 24. A free end of the counterbalance spring 22 is attached to winding shaft 31, such that rotation of the winding shaft 31 will adjust the amount of tension in counterbalance spring 22.

To maintain a selected tension on counterbalance spring 22, tensioning assembly 30 further includes a tension plate 35 that is slidably received on and rotationally coupled to winding shaft 31. Tension plate 35 may be keyed to winding shaft 31, for this purpose, or a suitable receiver formed in either of the winding shaft 31 or tension plate 35 that cooperates with a coupling surface on the opposite member may be used. In the embodiment shown, winding shaft 31 has a hexagonal outer surface 37 at its head portion 38 on which tension plate 35 is received, by way of a correspondingly formed hexagonal socket 39 found therein. To rotationally fix winding shaft 31 and maintain tension within counterbalance spring 22, tension plate 35 carries one or more locking members, generally indicated by the numeral 40, that are adapted to engage locking receivers, generally indicated by the numeral 41, formed in bracket 16 such that, when engaged (FIG. 6), tension plate 35, winding shaft 31 and the end of counterbalance spring 22 are held fixed against the torsional force, generally indicated by the arrow T in FIGS. 7, 8 and 9, of counterbalance spring 22 on bracket 16, such that, the torsional force T or tension within counterbalance spring 22 is maintained.

Figure 6A:
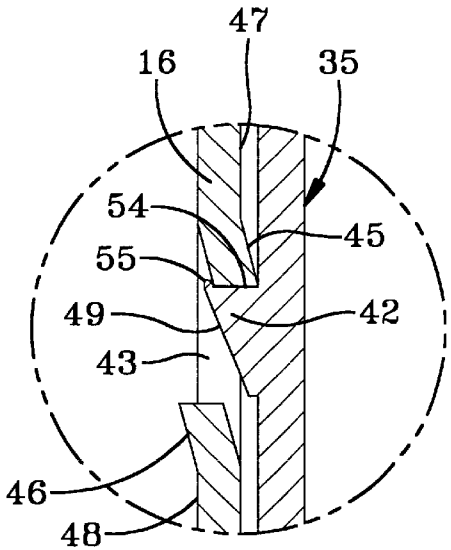
FIG. 6A is an enlarged partially sectioned view of the area indicated in FIG. 6 depicting further details of the tensioning assembly including details of the geometry of one locking member according to the present invention having a sloped end face and radially extending projection that rests against the bracket to provide a positive axial lock when the tension plate is in the engaged position.
Figure 6:
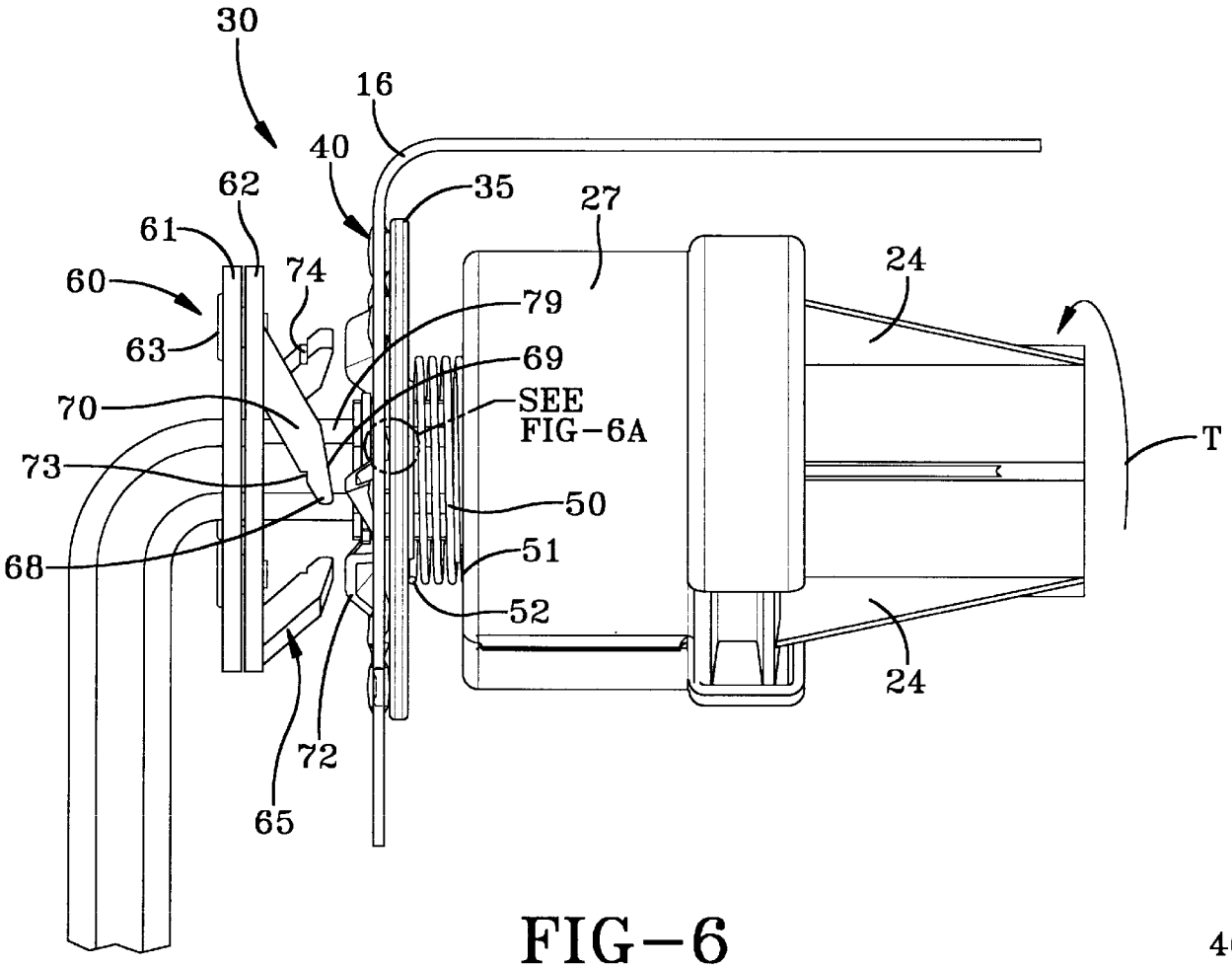
FIG. 6 is a top plan view of the tensioning assembly similar to FIG. 5 depicting the release assembly removed from the bracket and the tension plate returned to an engaged position under the force of the spring between the tension plate and the cable drum.
Figure 7:
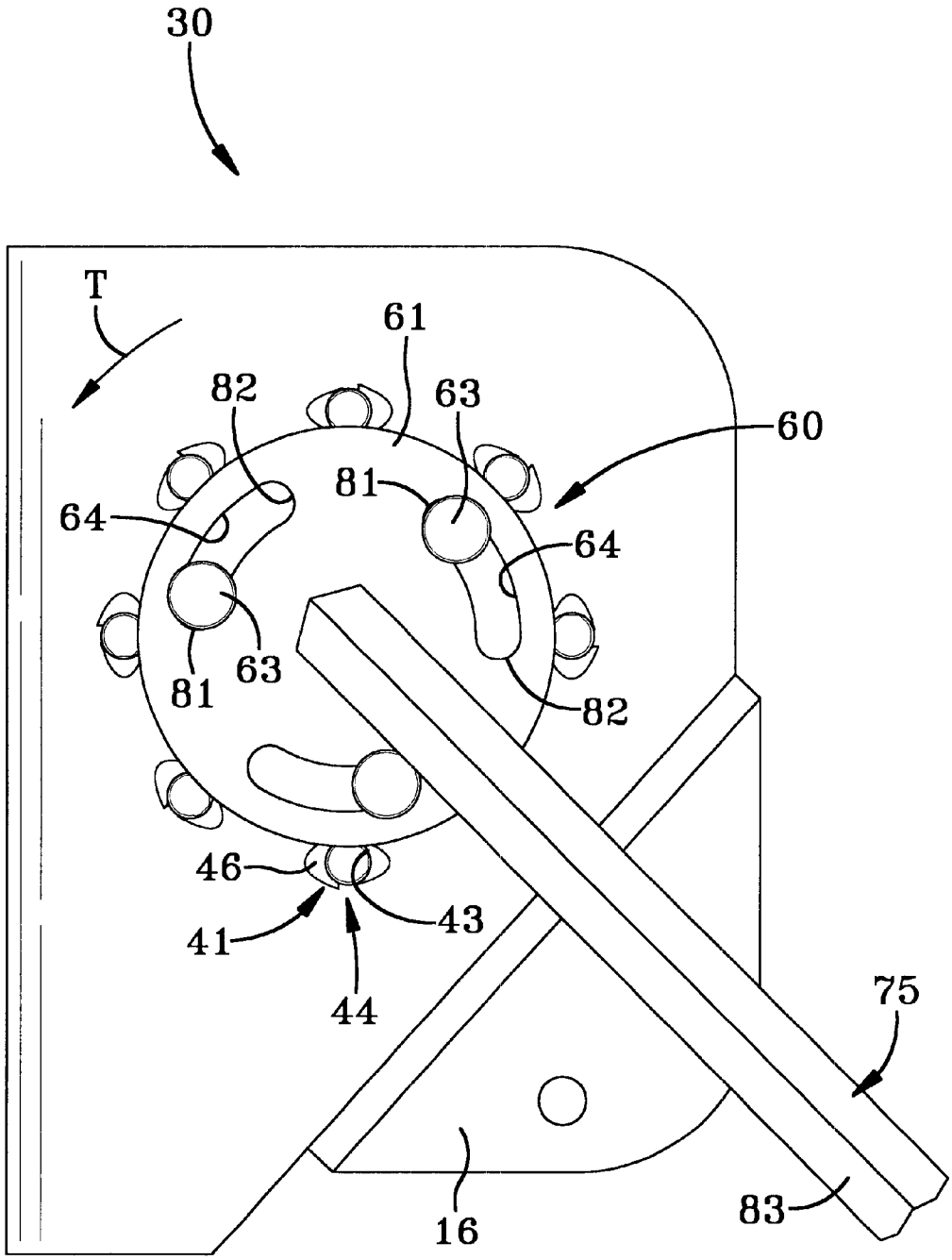
FIG. 7 is a left side elevational view of the tensioning assembly as seen in FIG. 6 depicting the tool rotated in a clockwise direction sufficient to cause shoulder pins extending from the first plate to contact the end of slots formed in the second plate and further rotated sufficient to cause the insertion of the fingers carried on the first plate through the slots to release the tension plate from the bracket such that the tension may be adjusted on the counterbalance spring.

In the embodiment depicted in FIG. 2A, a plurality of locking receivers 41 are located radially equidistant and circumferentially spaced at equal angles along a circle connecting the receivers 41. Tension plate 35 carries a number of locking members 40 equal to or less than the number of receivers 41 that project axially outward from tension plate 35 toward bracket 16 and may be in the form of circular-sectioned projections 42. To accommodate projections 42, locking receivers 41 may be provided with circular openings 43 through which projections 42 can extend. To reinforce the locking receivers 41, gussets, generally indicated by the numeral 44, may be provided adjacent openings 43 and be oriented such that their greatest dimension corresponds to the direction of force applied by projections 42. For example, the gussets 44, shown in FIG. 7, are of generally an oval-shape and aligned lengthwise substantially along the circle about which openings 43 are located. As best shown in FIG. 6A, diametrically opposed gusset portions 45, 46 of gussets 44 may be formed on opposite sides of bracket 16, such that a first gusset portion 45 is formed on a first side 47 and a second gusset portion 46 is formed on a second side 48 of bracket 16. As best shown in FIG. 6A, gusset portions 45 and 46 may be formed such that they deviate axially from the surfaces 47, 48 of bracket 16 to facilitate catching of the locking member 41 as it returns to the engaged position (FIG. 6). For example, second gusset portion 46 may extend axially outward relative to tension plate 35 and radially inward to form an inwardly sloping surface relative to the inside surface 47 of bracket 16 that leads the locking member 40 into the receiver 41. First gusset portion 45 may extend opposite second gusset portion 46 in an axial inward and radial inward fashion to improve the bite of the bracket 16 and catch the locking member 40 as it rotates into the engaged position. Additionally, the axial inward deviation of first gusset portion 45 provides clearance for a lip 55, described below. The use of deviating gusset portions 45, 46 reduces the likelihood that a locking member 40 would skip multiple receivers as it is returned to the engaged position.

To further facilitate engagement of the tension plate 35, projections 42 are provided with a sloped end 49 that slopes axially outward in a tangential direction related to the clockwise or counter-clockwise direction of the torsional force T exerted by counterbalance spring 22, such that the longer side 54 of projection 42 bears against the interior of opening 43. Accordingly, the shorter side of sloped end 49 facilitates progressive release of the tension plate 35, as will be described below. Sloped end 49 further may be used to allow tension to be applied to the counterbalance spring 22. For example, as shown in FIG. 6A, since the torsional force of the counterbalance spring 22 acts to place the longer side 54 of projection 42 in contact with the bracket 16, rotating the tension plate 35 in a direction opposite to the torsional force T would cause the sloped end 49 of the projection 42 to act on bracket 16 to gradually move the projection 42 axially inward such that the projection 42 does not impede rotation in this direction. An inwardly extending gusset portion 46 would facilitate such rotation by providing additional clearance for the shorter side of the projection 42. As shown in FIG. 6A, projections 42 may be provided with a radially extending projection, for example, a lip 55 extending radially outward of sloped end 49 to act as a positive lock to axial movement of the tension plate 35, when in the engaged position. Lip 55 extends radially outward from projection 42 in the direction of torsional force T, such that, when the tension plate rests in the engaged position, the torsional force T acting on tension plate 35 causes lip 55 to overlap a portion of bracket 16. It will be appreciated that lip 55 may be carried on bracket 16 to the same effect. Using lip 55 to interlock the bracket 16 and tension plate 35 in this fashion requires an initial rotation of the tension plate 35 before the tension plate 35 is axially disengaged from bracket 16. The effect of this is to cause the user to torque the tension plate 35 before the tension plate 35 is released, bracing the user against the torsional force T of the counterbalance spring 22, thereby reducing the risk of injury or accidental release of the tension plate 35. As an additional benefit, lip 55 reduces the likelihood of release of tension plate 35 in an uncontrolled manner, when the door system 10 is racked, such as may occur during an earthquake, in the case of a building, or when a truck having a door system 10 runs over a curb or other obstacle.

Once released, tension plate 35 may be moved axially such that the projections 42 clear the openings 41 of bracket 16. At this point the user is free to apply or release tension on the counterbalance spring 22 by rotating winding shaft 31. After tension on the counterbalance spring 22 is adjusted to the satisfaction of the user, with the projections 42 aligned with openings 41, the tension plate 35 is slid axially outward until the projections 42 engage openings 41 locking the tension plate 35 against further rotation.

Alternatively, tension plate 35 may be biased toward engagement with bracket 16. To that end, a spring, generally indicated by the numeral 50, is provided between the cable drum 24 and tension plate 35 to urge tension plate 35 into engagement with bracket 16. Spring 50 fits over the head portion 38 of winding shaft 31 and may be coaxial therewith. A radially extending flange 53,53 (FIG. 4) formed on head portion 38 (FIG. 4) or cable drum 24 and tension plate 35 facilitates location of spring 50 and provides a surface against which a first end 51 of the spring 50 may bear to create a biasing force applied to tension plate 35 at a second end 52 of spring 50. It will be appreciated that other suitable bearing surfaces may be provided to perform the same function. These surfaces maybe formed by other projections on the head portion 38, or the spring 50 may bear against cable drum 24. The relative lengths of spring 50 and head portion 38 are controlled such that the spring 50 is able to urge tension plate 35 into engagement with bracket 16. With the tension plate 35 biased into engagement with bracket 16, an axial force in opposition to the spring force must be applied before the tension plate 35 is released, further improving the safety of the tensioning assembly 30.

Figure 3A:
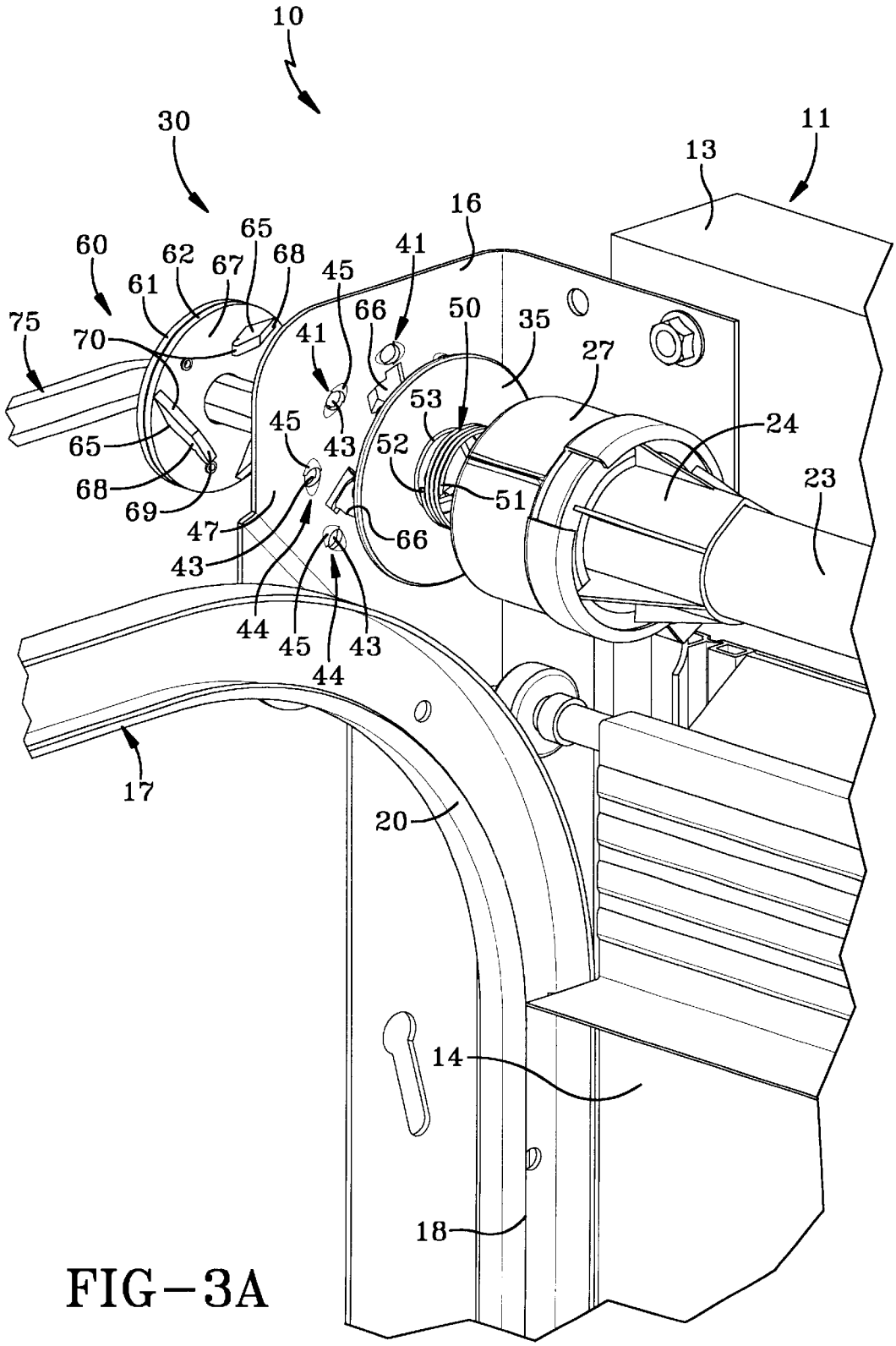
FIG. 3A is an enlarged exploded perspective view similar to FIG. 3 rotated 90° to show additional details of the tensioning assembly including details of the fingers extending from the first plate and extension of the working end of the tool through a circular bore formed in the first plate.

A release assembly, generally indicated by the numeral 60, may be used to release tensioning assembly 30 in a controlled fashion. As best shown in FIG. 2, release assembly 60 includes a first plate 61 and a second plate 62 that are axially coupled to each other by means of a shoulder pin 63, having a head portion and a shaft portion, carried on second plate 62 and received within arcuate slots 64 formed in first plate 61. Slots 64 are sized to permit relative rotation between first and second plates 61,62, as will be described more completely below. Second plate 62 carries a plurality of fingers, generally indicated by the numeral 65, that extend axially inward toward tension plate 35. Fingers 65 are in registry with corresponding finger slots 66 formed in bracket 16 such that fingers 65 may be selectively advanced through slots 66 to disengage tension plate 35 from bracket 16. Fingers 65 extend axially from second plate 62, and, to provide progressive axial insertion of fingers 65, as second plate 62 is rotated, are disposed at acute angles relative to the inner surface 67 of second plate 62. Each finger 65 is further oriented somewhat tangential in a single rotational direction. For example, fingers 65, shown in FIGS. 3A and 4, each have a tip 68 directed in a counterclockwise direction. As further shown in FIG. 6, tip 68 may have an oblique outer surface 69 relative to the base portion 70 of finger 65 to provide greater clearance for the remainder of the tip 68, as it enters wedge slot 66. As shown, wedge slot 66 may include an inwardly sloping guide channel 72 projecting axially and radially outward from the bracket 16 adapted to direct fingers 65 through slots 66 during rotation of release assembly 65. To provide an audible indication of the release of tension plate 35 from the bracket 16 caused by the insertion of the fingers 65 through slots 66, the inner surface 73 of tip 68 may be provided with an angular notch 74 that catches against guide channels 72 at a selected distance from the tip 68 corresponding to the length of projections 42 on tension plate 35 (FIG. 5).

Figure 5:
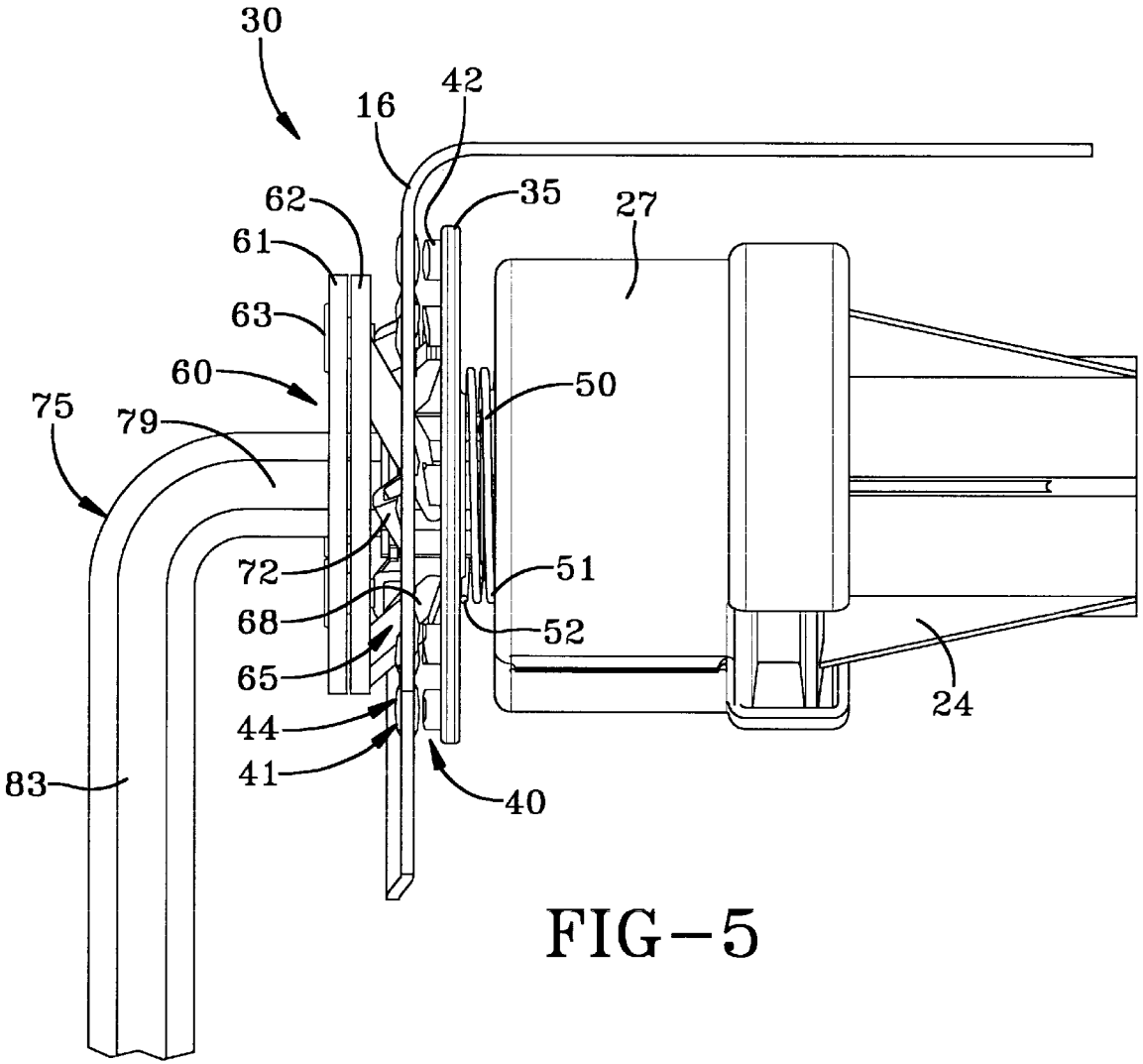
FIG. 5 is a top plan view of the tensioning assembly seen in FIG. 2 depicting details of the operation of the tensioning assembly including insertion of the fingers through the slots to incrementally release the locking members from the locking member receivers formed in the bracket by rotating the first plate, wherein the tensioning assembly is shown in a disengaged position where the spring between the cable drum and tension plate is compressed and the locking members have cleared the receivers.

As best shown in FIGS. 5 and 6, by rotating second plate 62, the user may effect gradual protrusion of the fingers 65 beyond the inner surface of bracket 16 to force tension plate 35 axially inward against the force of spring 50 to a released condition(FIG. 5), where locking members 41 clear receivers 40 releasing tension plate 35 from the bracket 16 and allowing adjustment of the tension on counterbalance spring 22. Once the counterbalance spring 22 is properly tensioned, fingers 65 are retracted, as by rotating the second plate 62 in the opposite direction, allowing the tension plate 35 to reassume a locked condition (FIG. 6) by moving locking members 41 within receivers 40.

A tool, generally indicated by the numeral 75, may be provided to adjust tension on counterbalance spring 22 and may, to advance and retract fingers 65, be coupled to release assembly 60 to effect rotation of the second plate 62. As shown, tool 75 may include a handle attached to the release assembly 60 that provides sufficient leverage for the rotation of release assembly 60 against the force of the counterbalance spring 60. Optionally tool 75 is inserted through release assembly 60 and provided with a key or bearing surface such that it may be rotationally coupled to first plate 61. In the embodiment shown, tool 75 is coupled to the first plate 61 by a hexagonal outer surface 76 that mates with a correspondingly formed hexagonal bore 78 on first plate 61. Second plate 62 may be provided with a circular bore 77, such that tool 75 may extend therethrough and rotate freely within bore 77 effecting a delay between torquing of the tool 75 and release of tension plate 35, as described in more detail below.

Figure 8:
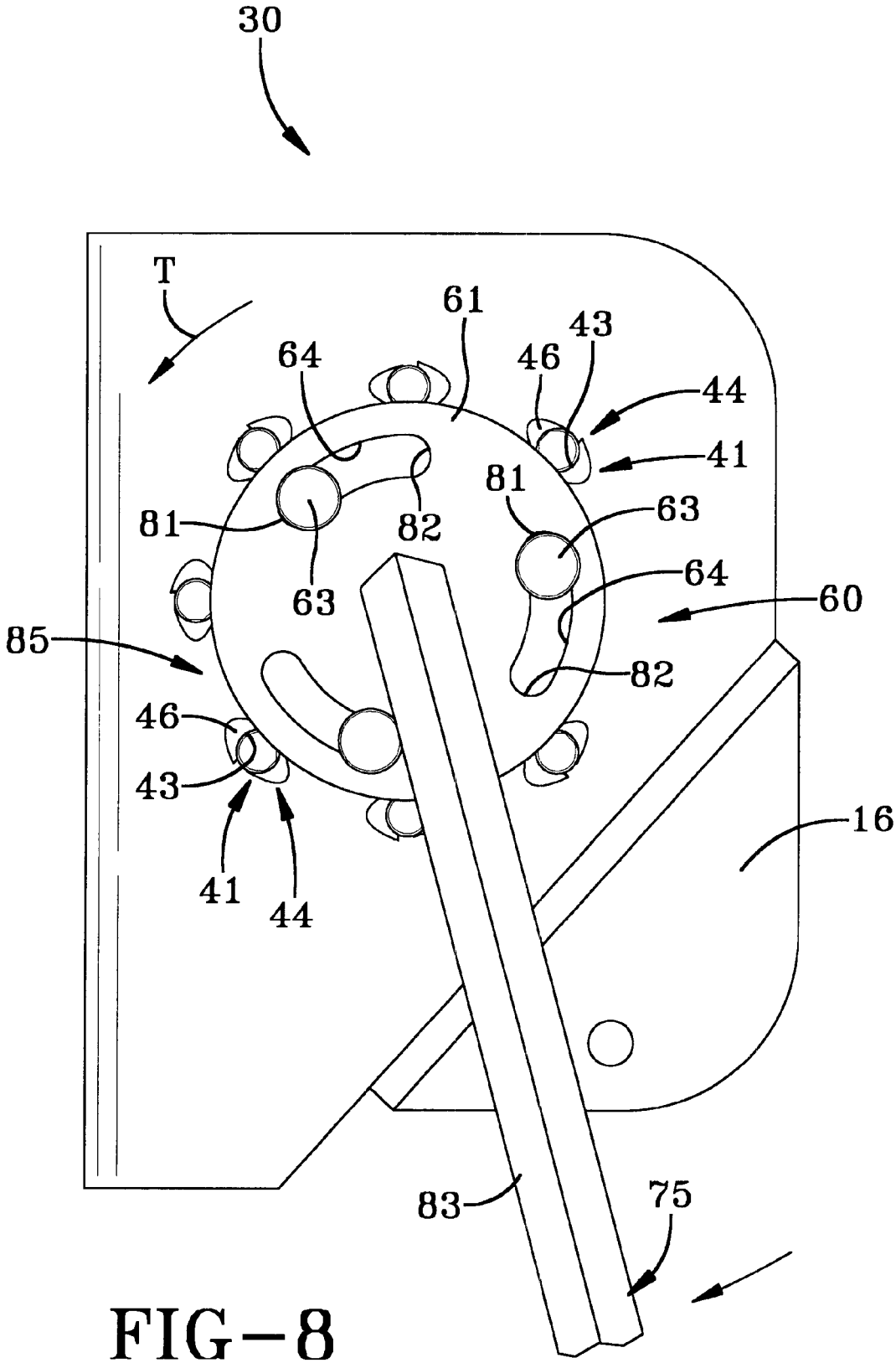
FIG. 8 is a left side elevational view of the tensioning assembly similar to FIG. 7 depicting the tool rotated to increase tension in the counterbalance spring.
Figure 9:
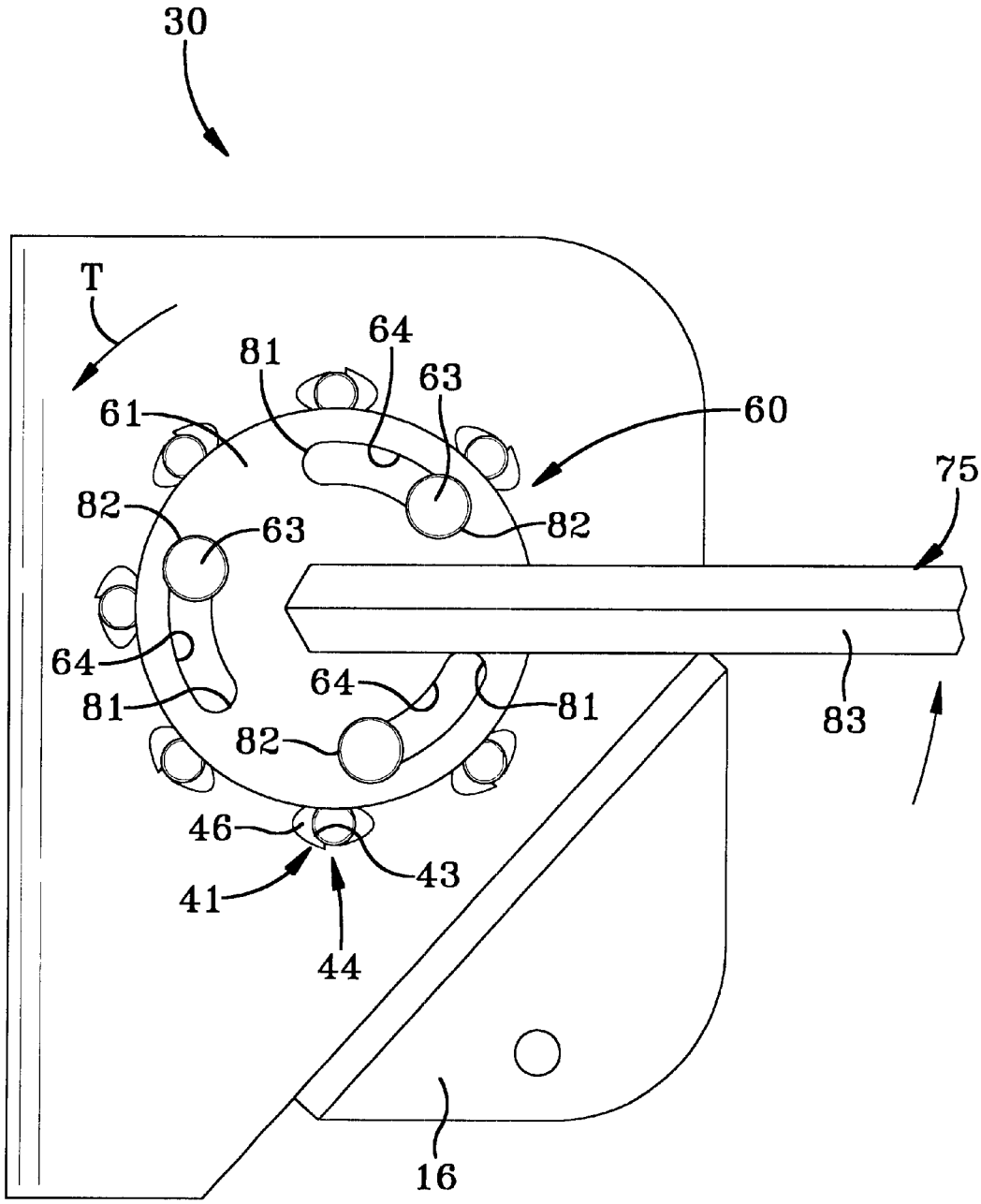
FIG. 9 is a left side elevational view of the tensioning assembly similar to FIG. 7 depicting the tool rotated to reduce tension in the counterbalance spring.

Slots 64 formed in first plate 61 allow rotation of the tool 75 and first plate 61 independent of second plate 62 until shoulder pins 63 engage either of the ends 81, 82 of slot 64. Thus, rotation of the tool 75 may occur independently of rotation of the second plate 62, which would act to insert or retract fingers 65. In operation, the tool 75, with first and second plates 61, 62 supported thereon may be initially placed in a position for insertion of the fingers 65 (FIG. 7). As shown, in this position, the shoulder pins 63 engage the first end 81 of slot 64. During rotation of the tool 75 from the position shown in FIG. 7 to a released position, shown in FIG. 8, contact between the shoulder pin 63 and the slot end 81 is maintained such that the second plate 62 rotates with the tool 75. As second plate 62 rotates, fingers 65 are progressively inserted with the oblique face 69 of tip 68 contacting tension plate 35 applying an axial force until the tension plate 35 is released (FIG. 8). To attain the released position (FIG. 8), the tool 75 must be rotated against the torsional force T of counterbalance spring 22, as indicated by the arrow in FIG. 8, from the initial position (FIG. 7) to the released position (FIG. 8). To reduce tension on the counterbalance spring 22, after the tension plate is 35 is released, as described, the tool 75 is rotated in the direction of the torsional force T. With the shoulder pin 63 in contact with first end 81 of the slot 64, in the released position (FIG. 8), slot 64 provides a clearance for rotation of the tool 75 in the direction of the torsional force T without causing rotation of the second plate 62. Therefore, the tool 75 may rotate in the direction of the torsional force T without retracting the finger 65 in a manner that would cause the tension plate 35 to engage bracket 16. Once the shoulder pins 63 have reached the second end 82 of slot 64, however, first plate 61 and second plate 62 become coupled, and further rotation of the tool 75 causes the second plate 62 to turn retracting fingers 65 returning the tension plate to the engaged position. For example, in FIG. 9, clockwise rotation of the tool 75 beyond the position shown, due to the contact of the shoulder pin 63 with a second end 82 of slots 64, will cause second plate 62 to rotate in a counterclockwise direction withdrawing fingers 65 allowing spring 50 to urge the tension plate 35 into engagement with bracket 16. It will be appreciated that additional adjustment of the tension of the counterbalance spring 22 beyond the increment provided by slot 64 may be made in a stepwise fashion by removing and resetting the tool 75. To increase tension in the counterbalance spring 22, the tension plate 35 may be released, as described above, and the tool 75 rotated against the torsional force T of the counterbalance spring. For example, referring to FIG. 8, further clockwise rotation of the tool 75 would increase the tension on the counterbalance spring 22 when using release assembly 60, as in the case of reducing tension on counterbalance spring 22, it may be necessary to add tension in a stepwise fashion by resetting tool 75. It will be appreciated that if locking members 40 having sloped ends 47 are used, as described above, tensioning of the counterbalance spring 22 may occur without using the release assembly 60. As mentioned, the sloped ends 49 of projections 42 may effect a gradual disengagement of tension plate 35 from bracket 16 by rotating the tension plate 35 in a direction opposite the torsional force T. In this way, the tool 75, by itself, may be rotationally coupled to the tension plate 35, as by inserting the working end 79 into an appropriately shaped socket, for example, hexagonal socket 78, on winding shaft 31, to which the tension plate 35 is rotationally coupled, and rotating the tool 75 until appropriate adjustment of the tension is achieved. It will be appreciated that application of tension to the counterbalance spring 22 may be limited by the confines of the structure in which the door system 10 is located. Therefore, it may be necessary to make stepwise adjustment of the tension by resetting the tool 75 as described above.

It will be appreciated that the use of tensioning assembly 30 flat plates, as opposed to gearing, as described above, results in a more compact tensioning assembly, which with the release assembly removed, occupies a small space between the cable drum 24 and bracket 16. The entire tensioning assembly 30 may fit within the lateral bounds of framers 12 just above tracks 17. While release assembly 60 is removable, when in use it too occupies a relatively small space. The plates 35,61,62 may be of similar size to cable drum 24 or have a diameter smaller than that of cable drum 24 such that no additional headroom is occupied by these components. In this way, a tensioning assembly 30 according to the present invention is suitable for applications where there is limited space near the upper extremity of door system 10.

In light of the foregoing, it should be apparent that the invention as described and shown provides a new and useful improvement in the art. It should further be noted that various modifications and substitutions may be made in the present invention without deviating from the spirit thereof. Thus, for an appreciation of the scope of the present invention, reference should be made to the following claims.

What is claimed is:

1. A tensioning assembly for a door system, which includes an upwardly acting door supported by a frame and connected to a counterbalance system having a counterbalance spring, the tensioning assembly comprising:

a rotatable tension plate coupled to the counterbalance spring, said tension plate being selectively moveable between a disengaged position where said tension plate is freely rotatable and an engaged position where said tension plate is rotationally fixed to the frame;

a spring adapted to urge said tension plate toward said engaged position, whereby when in said disengaged position said tension plate is rotatable to adjust tension in the counterbalance spring and said tension plate is returned to said engaged position to maintain the tension.

2. The tensioning assembly of claim 1, wherein said tension plate includes at least one locking member adapted to couple said tension plate to the frame, when said tension plate is in said engaged position.

3. The tensioning assembly of claim 2 further comprising, a bracket supported on said frame having at least one receiver adapted to receive said locking member, when said tension plate is in said engaged position, whereby receipt of said locking member in said receiver couples said tension plate to the frame.

4. The tensioning assembly of claim 3, wherein said bracket has a plurality of circumferentially spaced receivers.

5. The tensioning assembly of claim 4, wherein said receivers have an opening adapted to receive said locking member.

6. The tensioning assembly of claim 5 further comprising, a gusset adjacent said opening.

7. The tensioning assembly of claim 6, wherein said gusset is oriented substantially lengthwise along a circle on which said openings are located.

8. The tensioning assembly of claim 5 further comprising, a first gusset portion and a second gusset portion, each located on opposite sides of said opening and opposite sides of said bracket.

9. The tensioning assembly of claim 8 wherein said first gusset portion extends axially toward said tension plate and radially inward relative to said opening; and wherein said second gusset portion extends axially away from said tension plate and radially inward relative to said opening.

10. The tensioning assembly of claim 9 further comprising, a projection carried on said locking member extending radially outward in the direction of the force of the counterbalance spring and adapted to protrude radially of said opening upon engagement of said locking member and contact said bracket.

11. The tensioning assembly of claim 10, wherein said locking member has an end, said end being sloped outward in the direction of the force of the counterbalance spring.

12. The tensioning assembly of claim 4, wherein said tension plate includes a plurality of axially outward extending locking members of equal or fewer number than said plurality of receivers.

13. The tensioning assembly of claim 12 wherein said locking members are projections and said receivers are openings through which said projections extend when said tension plate is in said engaged position.

14. The tensioning assembly of claim 1 further comprising, a bracket mounted on the frame a release assembly including a first plate rotatably supported adjacent said bracket having a plurality of fingers registrable with a plurality of finger receivers formed in said bracket, said fingers being insertably received in said finger receivers and adapted to be selectively advanced by rotating said first plate to urge said tension plate to a disengaged position.

15. The tensioning assembly of claim 14 further comprising, a tool selectively coupled to said first plate, said tool having a working end adapted to rotate said first plate and a handle extending from said working end.

16. The tensioning assembly of claim 15 further comprising, a second plate supported on said working end of said tool adjacent said first plate, wherein said second plate includes a plurality of circumferentially spaced arcuate slots;

a plurality of shoulder pins extending from said first plate toward said second plate, said shoulder pins being slidably received in said slots whereby said first plate and said second plate are coupled to each other and partially rotatable with respect to each other; and said first plate being freely rotatable relative to said working end; said second plate being rotatably fixed relative to said working end, whereby rotation of said working end causes said second plate to rotate relative to said first plate until said shoulder pins engage said first plate causing said first plate to rotate with said second plate.

17. The tensioning assembly of claim 16 further comprising, a winding shaft rotatably supported on said bracket, said counterbalance spring being attached to said winding shaft, wherein said winding shaft is selectively coupled to said working end of said tool and rotatable therewith, and wherein said tension plate is rotationally fixed relative to said winding shaft and slidably received thereon.

18. The tensioning assembly of claim 17 wherein, said winding shaft defines a socket adapted to receive said working end of said tool formed in said winding shaft, wherein said working end of said tool is selectively insertably received within said socket to rotationally couple said working end to said winding shaft, whereby said working end of said tool is rotated to adjust the tension on the counterbalance spring.

19. The tensioning assembly of claim 1, wherein the counterbalance system has a cable drum and said tension plate has an outer dimension less than or equal to an outer diameter of the cable drum.

20. A tensioning assembly comprising, a bracket having a central bore, a plurality of slots circumferentially spaced relative to one another and spaced radially outward of said central bore, and a plurality of locking member receivers positioned radially outward of said central bore and circumferentially spaced relative to each other;

a winding shaft rotatably supported by said bracket and connected to a counterbalance spring rotatable to adjust tension within said spring, said winding shaft having a socket for receipt of a tool and adapted to rotationally couple said tool to said winding shaft, whereby rotation of said tool adjusts the tension on said counterbalance spring;

a tension plate slidably supported on said winding shaft and rotatably fixed thereto, said tension plate having a plurality of axially extending locking members extending toward said bracket, said locking members adapted to be received within said locking member receivers on said bracket to fix the rotational position of said winding shaft; and a release assembly adapted to selectively decouple said tension plate from said bracket, said release assembly including a first plate and a second plate, said first plate rotatably fixed to said tool and defining plural arcuate slots circumferentially spaced relative to one another, said second plate being coupled to said first plate by shoulder pins, said second plate carrying a plurality of fingers extending outwardly from said second plate toward said bracket and adapted to be received within said slots formed in said bracket, said fingers being circumferentially spaced with respect to one another wherein said fingers are adapted to advance upon rotation of said second plate in a first direction penetrating said slots and contacting said tension plate to urge said tension plate from a fixed rotational position.

21. A tensioning assembly for a door system, which includes an upwardly acting door supported by a frame and connected to a counterbalance system having a counterbalance spring, the tensioning assembly comprising:

a tension plate coupled to the counterbalance spring and rotatable relative to the counterbalance spring, said tension plate being selectively axially moveable between a disengaged position where said tension plate is freely rotatable and an engaged position where said tension plate is rotationally fixed to the frame; and means for selectively fixing the tension plate in the engaged position, whereby when in said disengaged position said tension plate is rotated relative to the counterbalance spring to adjust tension therein and said tension plate is returned to said engaged position to maintain the tension.

22. A tensioning assembly for a door system, which includes an upwardly acting door supported by a frame and connected to a counterbalance system having a counterbalance spring, the tensioning assembly comprising:

a tension plate coupled to the counterbalance spring and rotatable relative to the counterbalance spring, said tension plate being selectively moveable between a disengaged position where said tension plate is freely rotatable and an engaged position where said tension plate is rotationally fixed to the frame;

means for selectively fixing the tension plate in the engaged position, whereby when in said disengaged position said tension plate is rotated relative to the counterbalance spring to adjust tension therein and said tens ion plate is returned to said engaged position to maintain the tension; and biasing means adapted to urge said tension plate toward said engaged position.

23. A tensioning assembly for a door system, which includes an upwardly acting door supported by a frame and connected to a counterbalance system having a counterbalance spring, the tensioning assembly comprising:

a tension plate coupled to the counterbalance spring and rotatable relative to the counterbalance spring, said tension plate being selectively moveable between a disengaged position where said tension plate is freely rotatable and an engaged position where said tension plate is rotationally fixed to the frame;

means for selectively fixing the tension elate in the engaged position, whereby when in said disengaged position said tension plate is rotated relative to the counterbalance spring to adjust tension therein and said tension plate is returned to said engaged position to maintain the tension; and release means for selectively urging said tension plate from the engaged position to a said disengaged position.

24. A tensioning assembly for a door system, which includes an upwardly acting door supported by a frame and connected to a counterbalance system having a counterbalance spring, the tensioning assembly comprising:

a locking member attached to the counterbalance spring axially moveable to an engaged position to maintain a selected tension on the counterbalance spring; and a release assembly axially operatively movable to selectively disengage said locking member allowing adjustment of tension within the counterbalance spring.

25. The tensioning assembly of claim 24 further comprising, a receiver adapted to lockingly engage said locking member in the engaged position, wherein said release assembly is adapted to dislodge said locking member from said receiver to disengage said locking member.

26. The tensioning assembly of claim 25, wherein said release assembly includes a finger adapted to dislodge said locking member.

27. The tensioning assembly of claim 26, wherein locking member extends axially into said receiver and wherein said finger is moveable in the axial direction to dislodge said locking member.

28. The tensioning assembly of claim 27, wherein said finger is carried on a plate and extends axially outward from said plate and radially inward therefrom, said plate being rotatble to effect axial movement of said finger to dislodge said locking member.

29. The tensioning assembly of claim 28 further comprising, a tool rotatable to adjust tension on the counterbalance spring, said tool being selectively rotatably coupled to said plate, whereby rotation of said tool while said tool and said plate are coupled effects axial movement of said finger.

* * * * *